US008450951B2

(12) United States Patent
Booker et al.

(10) Patent No.: US 8,450,951 B2
(45) Date of Patent: May 28, 2013

(54) SYSTEM AND METHOD FOR GYROTRON POWER REGULATION

(75) Inventors: Larry Andrew Booker, Rialto, CA (US); John Walter Gerstenberg, Lake Elsinore, CA (US)

(73) Assignee: Raytheon Company, Waltham, MA (US)

( * ) Notice: Subject to any disclaimer, the term of this patent is extended or adjusted under 35 U.S.C. 154(b) by 1142 days.

(21) Appl. No.: 12/327,037

(22) Filed: Dec. 3, 2008

(65) Prior Publication Data

US 2010/0134007 A1 Jun. 3, 2010

(51) Int. Cl.
*H01J 23/00* (2006.01)

(52) U.S. Cl.
USPC ..... 315/500; 315/502; 315/5.13

(58) Field of Classification Search
USPC ..... 315/4, 5.13, 5.23, 5.33, 5.35, 5.43, 315/8.51, 39.51, 40, 41, 500–507
See application file for complete search history.

(56) References Cited

U.S. PATENT DOCUMENTS 6,456,009 B1 * 9/2002 Wright et al. ..... 315/5
6,979,420 B2 * 12/2005 Weber ..... 264/521

* cited by examiner

*Primary Examiner* — Jimmy Vu
(74) *Attorney, Agent, or Firm* — Schwegman Lundberg & Woessner, P.A.

(57) ABSTRACT

A system to regulate gyrotron power is configured to raise the filament voltage of a gyrotron to a standby voltage, then set the filament voltage to the normal standby voltage plus a current offset voltage before pulsing the gyrotron. The system is further configured to increase the filament voltage to a boost voltage that is higher than the standby voltage, thereby inducing a temperature increase in the cathode that offsets the cooling effect of radiating. The system is also configured to analyze a beam power of the gyrotron and adjust the filament voltage to bring a beam current within a range, and reduce the filament offset to zero such that the filament voltage is equal to the standby voltage.

18 Claims, 7 Drawing Sheets

SYSTEM AND METHOD FOR GYROTRON POWER REGULATION

STATEMENT OF GOVERNMENT INTEREST

This invention was made with United States Government support under contract number FA8728-05-C-0001 with the Department of the Air Force. The United States government has certain rights in this invention.

TECHNICAL FIELD

The present invention relates to gyrotrons, and in an embodiment, but not by way of limitation, gyrotron power regulation.

BACKGROUND

Gyrotrons are unregulated high power millimeter wave oscillators which can vary their output power under a wide range of pulse parameters. These parameters can vary in pulse duration, time between pulses, and the combination of short and long pulses, which results in variation of the output power. This variation in output power is undesirable, yet there exists no comprehensive method to generally solve this output power regulation problem. Attempts to solve this output power regulation problem depend on manual operator intervention, which requires highly trained technicians. Moreover, real time regulation performed in this manner is not practical for an operator who must focus on mission critical functions.

DETAILED DESCRIPTION

Figure 1:
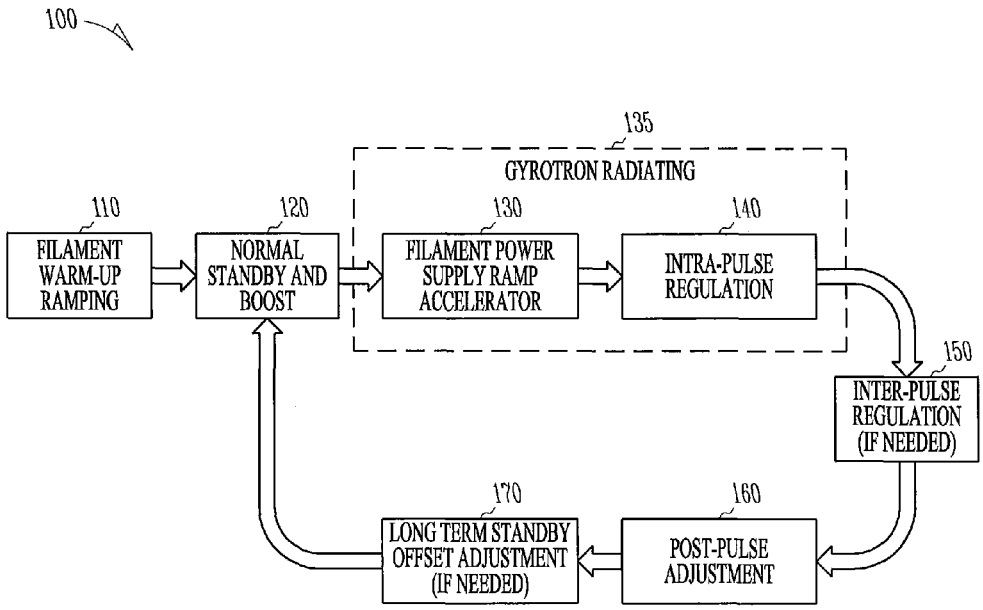
FIG. 1 illustrates several operating modes of an example embodiment of a system to regulate power in a gyrotron.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

In an embodiment, a method regulates output power during extensive hardware usage of a high power gyrotron oscillator. Typically, the power output may vary from about 75% to 105% of nominal without the herein disclosed active regulating routines. This variation depends on several parameters such as filament warm up time, time since last pulse, type and number of pulses recently taken, and other variables. To overcome this undesirable gyrotron output power performance, an embodiment encompasses a wide variety of possible pulse scenarios to not only maximize output power performance, but also to prevent unstable and potentially fault tripping conditions. Using this embodiment, the uncertainty power band can be shrunk from about 30% to about 1%. The 1% power band can be achieved when a series of more than three pulses is taken or a continuous pulse of 30 seconds or longer is fired. Several adjustment settings are available and can be tailored for other Gyrotron systems already in use. One or more embodiments achieve better regulation over wider scenarios than has been demonstrated by prior art.

In order to ensure consistency of power output of the gyrotron, it is helpful to regulate the temperature of the cathode by adjusting the voltage supplied to the filament. The normal or resting voltage of the filament is called the standby voltage. For the purposes of regulation, an embodiment can change the filament (or sometimes referred to herein as the Heater) voltage dynamically by adding a positive or negative offset voltage to this standby voltage.

In an embodiment, several software controlled routines automatically regulate the output power of the gyrotron by manipulating this offset voltage under inter-shot, intra-shot, and post-shot situations. These situations are unique and are handled differently by the software. The software is primarily built around the two firing situations of a continuous wave (CW) shot and small, rapid fire pulses, but the software transitions between them as required. These routines are categorized for different operational scenarios. These routines may bound the operating conditions under which the gyrotron will operate. They encompass various possible operator scenarios and predict output power. Then, by making necessary adjustments to optimize performance, regulated power output and gyrotron stability are provided.

In an embodiment, key variables are monitored, and from the interaction of these variables, the power output of a gyrotron is predicted and heater voltages are modified to tightly maintain power output levels.

The power regulating routines automatically regulate the output power of the gyrotron. These routines can be implemented in software and/or hardware. Irrespective of the implementation, the regulating routines manage an offset voltage (from the standby voltage) under pre-pulse, inter-pulse, intra-pulse, and post-pulse situations. These situations are unique and each situation is handled differently by the routines. The routines are primarily built around the two firing situations but the routines transition between them as required. There are seven routines 100 shown in FIG. 1, and they can be categorized as follows—Filament Warmup Ramping 110, Normal STANDBY & Boost 120, Intra-pulse Regulation 140, Inter-pulse Regulation 150, Post-pulse Adjustment 160, Long Term STANDBY Offset Adjustment 170, and Filament Power Supply Ramp UP & DOWN Accelerator 130. The filament power supply ramp accelerator 130 and intra-pulse regulation 140 are used during a time of gyrotron radiating 135.

Figure 2:
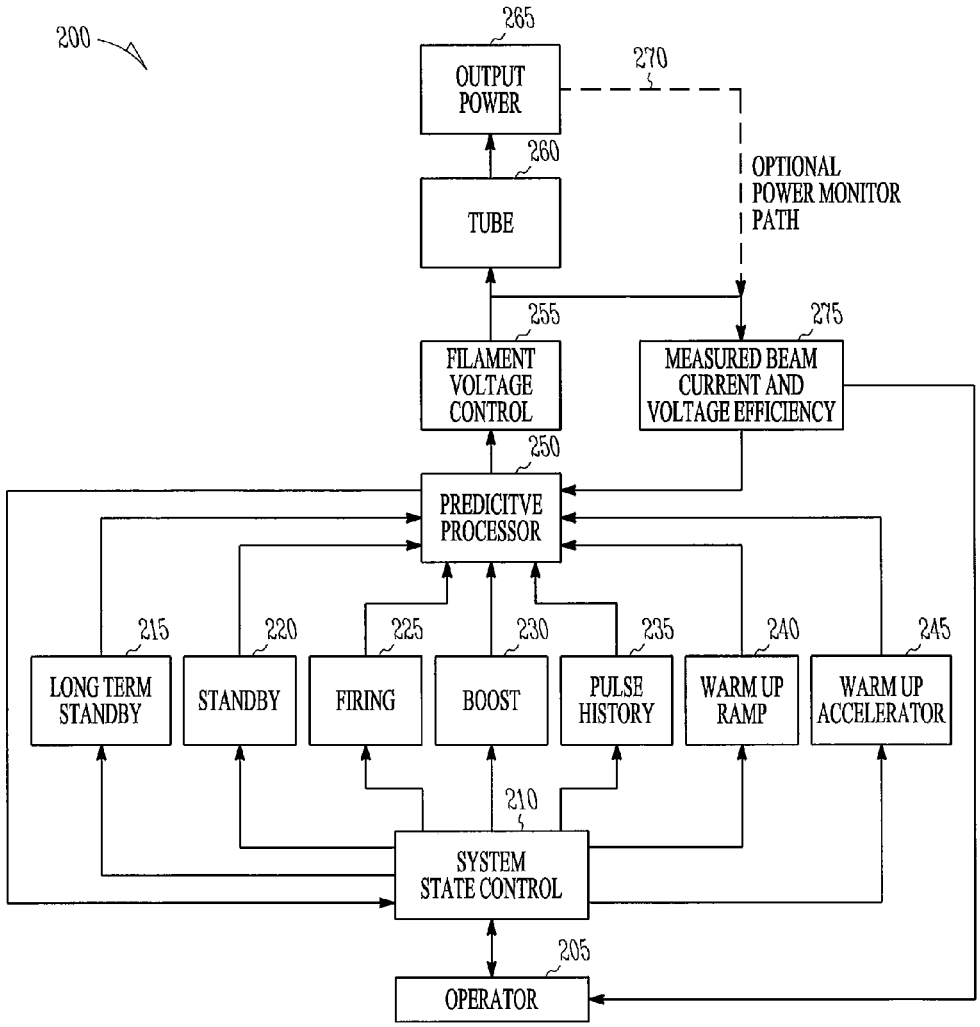
FIG. 2 is a block diagram of an example system to regulate power in a gyrotron.

By knowing and using the physics and measured power characteristics of the high power tube under different firing conditions (i.e., pre-pulse, inter-pulse, intra-pulse, and post-pulse situations), optimal power regulation of the output can be achieved by using such routines as predictive Kalman filtering. The output power leveling can be either closed loop with a power feedback or open loop depending on how well the tube characteristics are known. In FIG. 2, a system diagram 200 illustrates how the different elements can be organized to allow output power regulation. An operator 205 interacts with the system 200 via a system state control 210. The operator 205, via the system state control 210 can invoke any of the modules long term standby 215, standby 220, firing 225, boost 230, pulse history 235, warm up ramp 240, and warm up accelerator 245. The pulse history 235 determines prior shot characteristics, which can be used to determine what post shot actions should be taken. These actions may include clearing the filament offset voltage back to zero, increasing the offset voltage following a CW shot, or increasing the offset voltage due to long term gyrotron activity. A predictive processor 250 analyzes input from one or more of the modules 215 through 245, and invokes a filament voltage control module 255, which can alter a voltage to the tube 260, thereby regulating the output power 265. The efficiency of the gyrotron's current and beam efficiency can be determined at 275. In an embodiment, the output power serves as a feedback 270 to the current and voltage of the gyrotron beam. Different modes (215-245) are entered depending on tube parameters, firing history, filament status, and output power. These parameters then change the filament drive to the tube and stabilize the output power.

Figure 3:
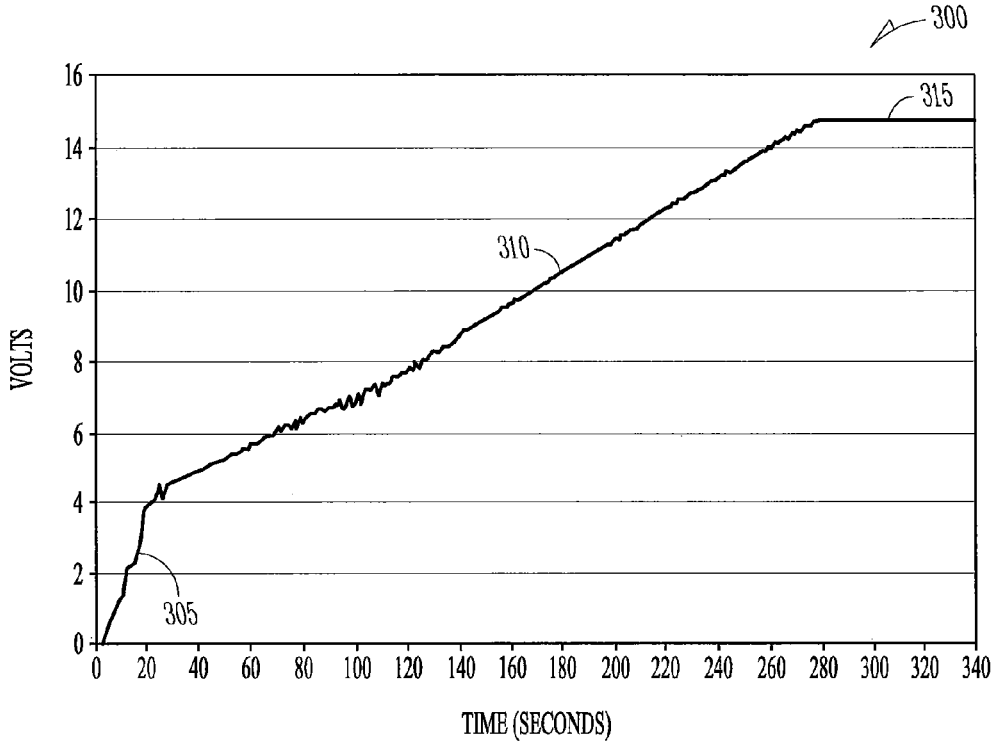
FIG. 3 illustrates an example graph of a filament voltage warm up or ramp up.

The filament is initially warmed up by gradually raising the voltage of the filament to the normal standby voltage. This can occur over a period of about 5½ minutes. Referring to the graph 300 of FIG. 3, the first step of the sequence is to ramp up the voltage quickly to a predetermined voltage over a predetermined period of time, as illustrated in section 305 of the graph 300. The next step is to slowly ramp the voltage higher, as illustrated in section 310, until the standby voltage is reached. After the standby voltage is reached, a 60 second settling time 315 is enforced before the filament is determined to be ready to radiate. In some embodiments, the predetermined voltage may be 5 volts, the predetermined period of time may be 30 seconds, and the settling time 315 may be 60 seconds, although the scope of the embodiments is not limited in this respect.

Normal STANDBY & Boost. Before a pulse, the filament voltage is set to the normal standby voltage plus the current offset voltage. Immediately after a pulse begins, the filament voltage increases to a boost voltage that is higher than the standby voltage. This voltage induces a temperature increase in the cathode that offsets the cooling effect caused by radiating.

The normal offset voltage and the boost voltage normally cannot be set by the user. They are preset by the test engineers during the testing period. There are no configurable parameters for the normal standby and boost.

Figure 4:
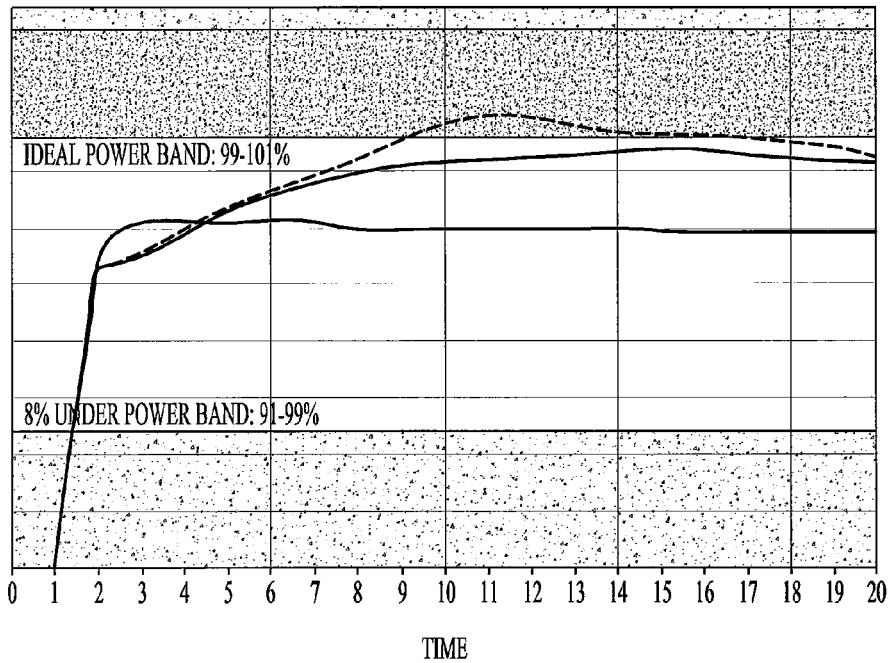
FIG. 4 illustrates an example graph of an intra-pulse beam current compensation.

Intra-pulse Regulation. If the pulse continues beyond a few seconds, the software will analyze the beam power and make dynamic corrections to the filament voltage to bring the beam current within an ideal range, which can be determined by referring to a graph such as FIG. 4. The software will predict the future beam current and adjust the filament offset voltage up or down in order to regulate the beam current into the ideal power band.

Figure 5:
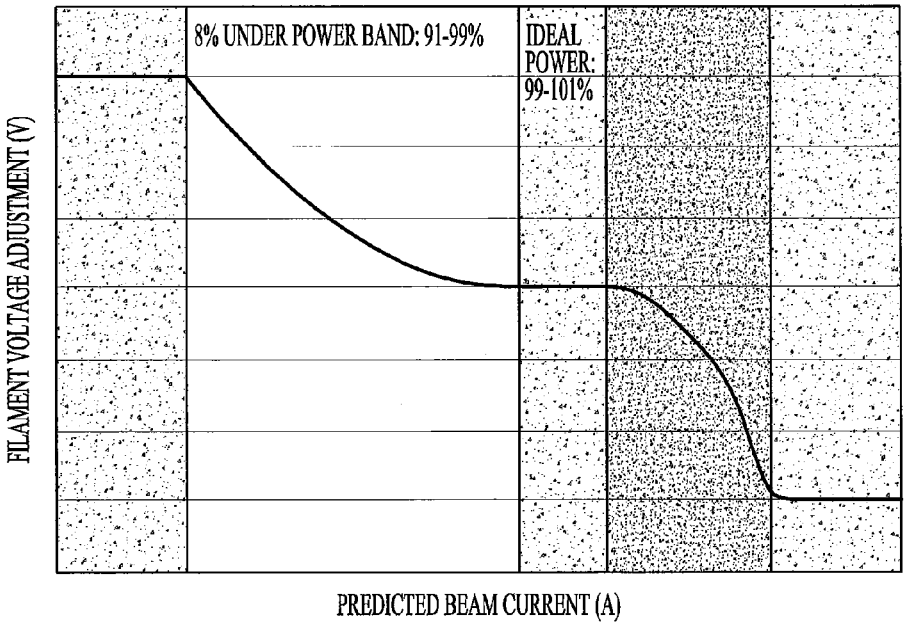
FIG. 5 illustrates an example graph of filament voltage adjustment versus predicted beam current.

The prediction is generated by measuring the change of the beam power and extrapolating from that what the beam current would be in approximately 15 seconds if no filament voltage changes are made. If the predicted beam current is within an ideal power band, the software will take no corrective action, even if the beam current of the present pulse is not within the band. If the predicted beam current is below the ideal power band, the filament voltage offset will be increased based on the difference between the bottom of the ideal power band and the predicted beam current. Any pulses that are lower than the 8% underpower band, for example, may be treated like a lowest value in the underpower band. An example is illustrated in FIG. 5.

The offset voltage increase is computed by normalizing the distance from the ideal power band to a percentage, then squaring this percentage to get a quadratic curve. This squared normalized distance is then multiplied by a voltage constant to get the desired change in filament voltage. The voltage constant is a function of the particular gyrotron that is being used. This voltage constant may change as the gyrotron ages, and may have to be recalculated. This voltage constant can be determined by making slight incremental changes, increases or decreases, to the present offset adjustment routines and then test firing the gyrotron under various CW and pulse conditions until the desired performance is achieved. Depending on how the Gyrotron ages, offset values may need to be reduced or increased. Performance characteristics may change due to aging simply by firing the Gyrotron frequently or even with extended inactivity while in storage. This additional change in voltage is then applied to the present offset voltage. The use of a quadratic curve ensures that very small changes are made near the ideal power band while still allowing large changes when the distance is great.

When the predicted beam current is above the ideal power band, the offset voltage will be decreased using the 4% overpower band (top band in FIG. 4) in the same manner as the underpower band (lower band in FIG. 4) is used when the predicted beam current is below the ideal power band.

There are several configurable parameters that can be used in connection with the intra pulse regulation. A continuous wave (CW) CW Filament Interval Time is the time between checks of the beam current/filament during a CW pulse (units are seconds). A CW Filament Settle Time is the time to allow the beam current to settle before checking beam current/filament during a CW pulse. A CW Filament Maximum Increment is a maximum amount to increment filament voltage when beam current is low. A CW Filament Maximum Decrement is a maximum amount to decrement filament voltage when beam current is high. A CW Filament Maximum Voltage is a maximum voltage to allow the filament to reach.

Post-pulse Adjustment. After a series of pulses is over, the regulated filament voltage may be higher or lower than the standby voltage because of a negative or positive offset voltage. In the case of an elevated filament voltage, maintaining the final voltage reached during regulation without further radiating may cause the cathode to overheat. This overheating would then cause the user's next pulse to be extremely high power, possibly reaching the current limit of the high voltage supplies. If a lowered filament voltage was maintained, the cathode could cool excessively and the user's next pulse would be underpowered.

Figure 6:
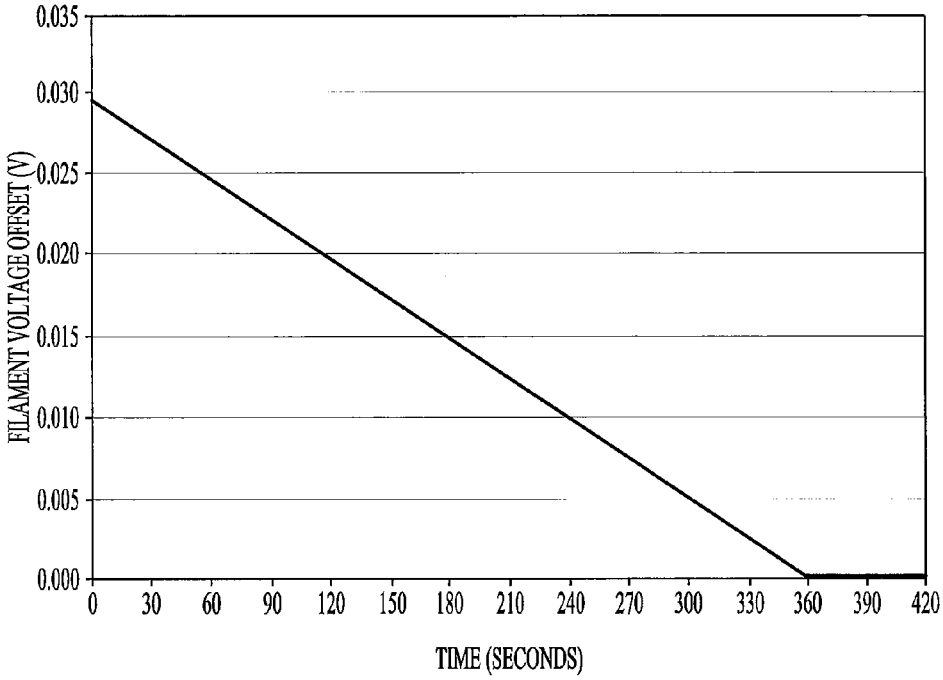
FIG. 6 illustrates an example graph of non-radiating filament voltage adjustments.

In order to handle both these cases, the software slowly but continuously reduces the filament voltage offset to zero. When the filament offset voltage reaches zero, the filament voltage will be again identical to the standby voltage. An example is illustrated in FIG. 6.

In the case of a very long continuous wave (CW) pulse (greater than 30 seconds), the cathode can release some contaminants and become more efficient. This increased efficiency can persist for several days and should be accounted for by the software. Therefore, after a CW pulse that lasts more than 30 seconds, the standby voltage will be reduced based on the length of the pulse. A pulse of less than 30 seconds causes no long term change, while any pulse longer than 120 seconds causes the maximum change. These time parameters are configurable and would be tailored to the individual gyrotron during the testing stages.

Figure 7:
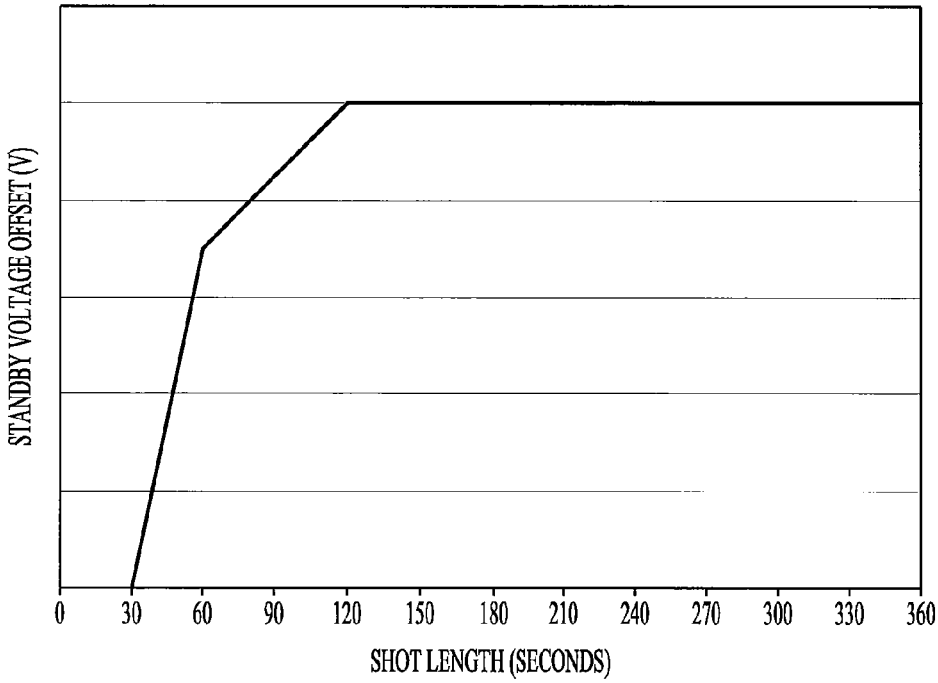
FIG. 7 illustrates an example graph of standby voltage reduction versus continuous wave (CW) pulse length.

This reduction in the standby voltage will prevent the gyrotron from experiencing overcurrent faults in the minutes after the CW pulse is complete. These overcurrent faults would result both from the residual heat in the cathode and from the increased efficiency of the decontaminated cathode. An example is illustrated in FIG. 7.

In post pulse adjustment 160, configurable parameters include a Filament Idle Enabled that enables the automatic filament decrement when the gyrotron is idle. A Filament Idle Interval is the idle time before the filament voltage is reduced. A Filament Idle Target Offset is the final desired filament voltage offset. A Filament Idle Decrement is the size of increment or decrement of filament voltage when the gyrotron is idle. A CW Filament 60 s (seconds) Standby Decrease is the maximum decrease in filament offset after a long pulse. A CW Filament 120 s (seconds) Standby Decrease is the minimum decrease in filament offset after a long pulse.

Long Term STANDBY Offset Adjustment. The changed standby voltage will persist until it is reset by the software based on a "first of day" calibration pulse. This is a pulse that meets very specific requirements that ensure it can be used to calibrate the standby voltage. When a pulse is taken that meets these requirements, the software will adjust the filament standby voltage based on the beam current of the pulse. This continuous calibration routine will ensure that the standby voltage is always properly set for the desired beam power. The very specific First of Day Pulse Requirements include a Power Level Setting such that the software does not calibrate the filament voltage at the lower power level settings. A Pulse Duration such that the pulse may be long enough to ensure that there was no error or truncation in the high voltage ramp. A short enough Pulse Duration such that the pulse must not enter the CW pulse regulation window. A Time Since Last Pulse great enough so that the filament has settled at its programmed voltage and achieved a steady state temperature. A Filament On Time great enough to avoid having an artificially cold filament confuse the algorithm. A Time Since Last CW Pulse great enough to avoid having an artificially hot filament confuse the algorithm.

Figure 8:
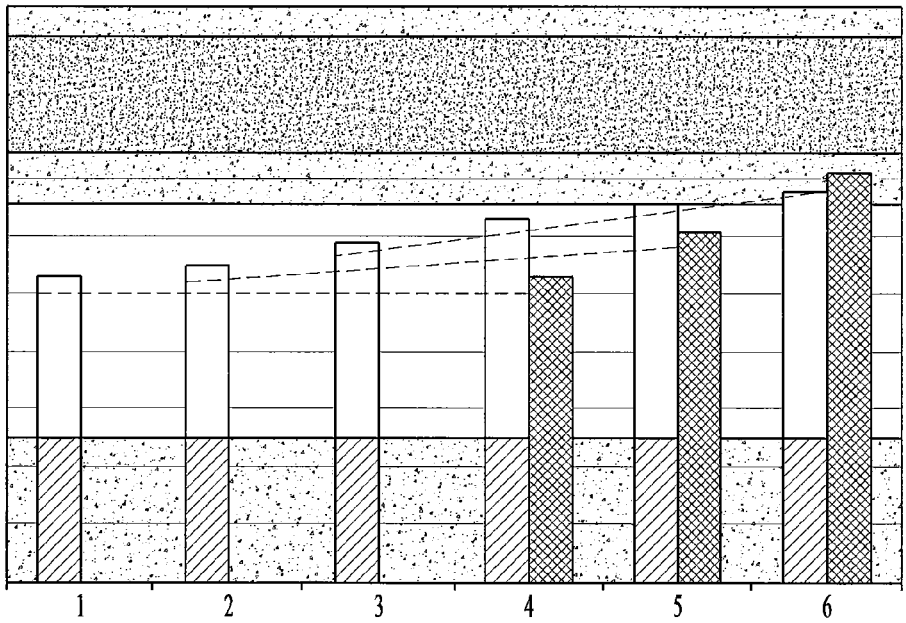
FIG. 8 illustrates an example graph of an inter-pulse beam current prediction.

Inter-pulse Regulation. Inter-pulse regulation regulates the filament voltage with the goal of maintaining beam current within an acceptable percentage band while firing repeated pulses. This regulation is performed by predicting the future beam current (assuming a high rate of firing is maintained) and regulating the filament offset voltage based on the future predictions. Because of the slow reaction of the beam current to the changing voltage, this prediction is necessary to minimize oscillation and overcorrection. An example is illustrated in FIG. 8.

The new offset voltage is calculated in the same way as the intra-pulse adjustments, using the distance of the predicted beam current from the ideal power band to control the voltage changes. When the predicted current is within the band, no changes are made to the offset voltage. When the predicted current is above or below the band, the voltage is decreased or increased to bring the beam current back within the ideal bounds.

Through this use of prediction, the effect of the changing filament voltage on the beam current can be seen throughout repeated pulses. Within just a few pulses, the beam current is quickly regulated to be within the ideal power band and maintained throughout the remaining pulses. Configurable parameters for the inter pulse regulation include a Filament Offset Minimum which is the lowest value to which filament offset can be set. A Filament Offset Maximum which is the highest value to which filament offset can be set. A Filament Maximum Increment which is the maximum increment of a filament voltage when a beam current is low. A Filament Maximum Decrement which is a maximum decrement of a filament voltage when a beam current is high. A Filament Low HVPS Decrement which is an immediate decrement of filament voltage when a high voltage power supply (HVPS) controller experiences a current limit.

Filament Power Supply Ramp UP & DOWN Accelerator is a routine that maximizes the speed at which the filament power supply for the gyrotron can ramp up or down in voltage without overshoot. By accelerating this ramp, faster power adjustments can be made while at the same time reducing power oscillation swings. In turn, this allows faster cool down times between subsequent pulses, reducing the "thermal stacking" problem caused by repeated firing.

This software accelerates the voltage change by commanding a higher or lower voltage than is actually desired. When the measured voltage passes the desired voltage while seeking the commanded voltage, the software commands the correct voltage, and the power supply stops its ramp at the correct voltage.

FIG. 9 is a flowchart of an example process 900 for regulating output power of a gyrotron. FIG. 9 includes a number of process blocks 905-996. Though arranged serially in the example of FIG. 9, other examples may reorder the blocks, omit one or more blocks, and/or execute two or more blocks in parallel using multiple processors or a single processor organized as two or more virtual machines or sub-processors. Moreover, still other examples can implement the blocks as one or more specific interconnected hardware or integrated circuit modules with related control and data signals communicated between and through the modules. Thus, any process flow is applicable to software, firmware, hardware, and hybrid implementations.

FIG. 9 illustrates an embodiment of an example process 900 that includes the steps of raising a filament voltage of a gyrotron to a standby voltage at 905, setting the filament voltage to the normal standby voltage plus a current offset voltage before pulsing the gyrotron at 910, increasing the filament voltage to a boost voltage that is higher than the standby voltage, thereby inducing a temperature increase in the cathode that offsets the cooling effect of radiating at 915, and analyzing a beam power of the gyrotron and adjusting the filament voltage to bring a beam current within a range at 920. At 922, the analyzing the beam power includes predicting a future beam current and adjusting the filament offset voltage to regulate the beam current into an ideal power band. At 925, the process 900 includes the step of reducing the filament offset to zero such that the filament voltage is equal to the standby voltage. The process 900 can also include raising the voltage of the filament to the standby voltage by a first ramping up of the voltage to approximately 5 volts over a period of approximately 30 seconds at 930, raising the voltage of the filament by a second ramping up of the voltage over a period of approximately 5 minutes until the standby voltage is reached at 935, and providing a settling time of approximately 60 seconds before determining that the filament is ready to radiate (wherein the first ramping up is at a rate that is less that the rate of the second ramping up) at 940.

The process 900 can further include measuring a change in the beam power at 945, extrapolating to determine the beam current in approximately 15 seconds if no filament voltage changes are made at 950, taking no corrective action if the predicted future beam current is within the ideal power band at 955, and at 960, when the predicted beam current is below the ideal power band, increasing the filament offset voltage as a function of a difference between a lower limit of an ideal band and the predicted future beam current. At 961, the determination of the offset voltage increase includes that steps of normalizing a distance from the ideal power band to a percentage, squaring the percentage, multiplying the squared percentage by a voltage constant to get a desired change in the filament voltage, and adding the desired change in filament voltage to the offset voltage. At 962, when the predicted future beam current is above the ideal power band, the offset voltage is decreased using an overpass band. At 963, the overpass band is an approximately 4% overpass band. At 965, one or more of the following configurable parameters are used—a continuous wave (CW) filament interval time, a CW filament settle time, a CW filament maximum increment, a CW filament max decrement, and a CW filament maximum voltage. At 970, when a pulse duration is approximately 30 seconds or longer, the standby voltage is reduced as a function of the duration of the pulse. At 975, one or more of the following configurable parameters are used—a filament idle enabled, a filament idle interval, a filament idle target offset, a filament idle decrement, a continuous wave (CW) filament 60 s (seconds) standby decrease, and a CW filament 120 s (seconds) standby decrease.

The process 900 may further include the step of adjusting the filament standby voltage as a function of the beam current of the pulse to maintain a proper setting of the standby voltage for a desired beam power at 980, and using one or more of the following—a power level setting, a pulse duration, a time since last pulse, a filament on time, and a time since last continuous wave (CW) pulse at 985. At 990, when repeated pulses are transmitted to the filament, a future beam current is predicted and the filament offset voltage is regulated as a function of the future beam current. At 991, the process 900 includes the step of calculating a new offset voltage by using a distance of the predicted future beam current from an ideal power band, and at 992, making no changes in the offset voltage when the predicted future beam current falls within the ideal power band. The process 900 can also include at step 993 increasing the offset voltage when the predicted future beam current falls below the ideal power band or decreasing the offset voltage when the predicted future beam current falls above the ideal power band, thereby bringing the beam current back into the ideal power band. At 994, one or more of the following configurable parameters can be used—a filament offset minimum, a filament offset maximum, a filament maximum increase, a filament maximum decrement, and a filament low High Voltage Power Supply decrement. At 995, there is a step of maximizing a speed at which a filament power supply for a gyrotron can ramp up or ramp down in voltage without overshoot. At 996, there is the step of commanding a higher voltage or a lower voltage than actually desired, and when the measured voltage passes the desired voltage, commanding the correct voltage and stopping the ramp up or ramp down of the power supply at the correct voltage.

In the foregoing detailed description of embodiments of the invention, various features are grouped together in one or more embodiments for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the detailed description of embodiments of the invention, with each claim standing on its own as a separate embodiment. It is understood that the above description is intended to be illustrative, and not restrictive. It is intended to cover all alternatives, modifications and equivalents as may be included within the scope of the invention as defined in the appended claims. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

The abstract is provided to comply with 37 C.F.R. 1.72(b) to allow a reader to quickly ascertain the nature and gist of the technical disclosure. The Abstract is submitted with the understanding that it will not be used to interpret or limit the scope or meaning of the claims.

The invention claimed is:

1. A process for gyrotron power regulation comprising:

using a processor for raising a filament voltage of a gyrotron to a standby voltage;

using the processor for setting the filament voltage to the standby voltage plus a current offset voltage before pulsing the gyrotron;

using the processor for increasing the filament voltage to a boost voltage that is higher than the standby voltage, thereby inducing a temperature increase in the cathode that offsets the cooling effect of radiating;

using the processor for analyzing a beam power of the gyrotron and adjusting the filament voltage to bring a beam current within a range;

raising the voltage of the filament to the standby voltage by a first ramping up of the voltage to a predetermined voltage over a predetermined time period;

raising the voltage of the filament by a second ramping up of the voltage over a second predetermined time period; and providing a settling time before determining that the filament is ready to radiate;

wherein the first ramping up is at a rate that is less that the rate of the second ramping up.

2. The process of claim 1, comprising reducing the filament offset to zero such that the filament voltage is equal to the standby voltage.

3. The process of claim 1, comprising using one or more of the following configurable parameters: a continuous wave (CW) filament interval time, a CW filament settle time, a CW filament maximum increment, a CW filament max decrement, and a CW filament maximum voltage.

4. A process for gyrotron power regulation comprising:

using a processor for raising a filament voltage of a gyrotron to a standby voltage;

using the processor for setting the filament voltage to the standby voltage plus a current offset voltage before pulsing the gyrotron;

using the processor for increasing the filament voltage to a boost voltage that is higher than the standby voltage, thereby inducing a temperature increase in the cathode that offsets the cooling effect of radiating;

using the processor for analyzing a beam power of the gyrotron and adjusting the filament voltage to bring a beam current within a range;

measuring a change in the beam power;

extrapolating to determine the beam current in approximately 15 seconds if no filament voltage changes are made;

taking no corrective action if the predicted future beam current is within the ideal power band; and when the predicted beam current is below the ideal power band, increasing the filament offset voltage as a function of a difference between a lower limit of an ideal band and the predicted future beam current;

wherein analyzing the beam power comprises predicting a future beam current and adjusting the filament offset voltage to regulate the beam current into a power band.

5. The process of claim 4, wherein determining the offset voltage increase comprises:

normalizing a distance from the ideal power band to a percentage;

squaring the percentage;

multiplying the squared percentage by a voltage constant to get a desired change in the filament voltage; and adding the desired change in filament voltage to the offset voltage.

6. The process of claim 4, comprising:

when the predicted future beam current is above the ideal power band, decreasing the offset voltage using an overpass band.

7. The process of claim 6, wherein the overpass band is an approximately 4% overpass band.

8. A process for gyrotron power regulation comprising:

using a processor for raising a filament voltage of a gyrotron to a standby voltage;

using the processor for setting the filament voltage to the standby voltage plus a current offset voltage before pulsing the gyrotron;

using the processor for increasing the filament voltage to a boost voltage that is higher than the standby voltage, thereby inducing a temperature increase in the cathode that offsets the cooling effect of radiating; and using the processor for analyzing a beam power of the gyrotron and adjusting the filament voltage to bring a beam current within a range when a pulse duration is approximately 30 seconds or longer, reducing the standby voltage as a function of the duration of the pulse.

9. The process of claim 8, comprising using one or more of the following configurable parameters: a filament idle enabled, a filament idle interval, a filament idle target offset, a filament idle decrement, a continuous wave (CW) filament 60 s (seconds) standby decrease, and a CW filament 120 s (seconds) standby decrease.

10. A process for gyrotron power regulation comprising:

using a processor for raising a filament voltage of a gyrotron to a standby voltage;

using the processor for setting the filament voltage to the standby voltage plus a current offset voltage before pulsing the gyrotron;

using the processor for increasing the filament voltage to a boost voltage that is higher than the standby voltage, thereby inducing a temperature increase in the cathode that offsets the cooling effect of radiating;

using the processor for analyzing a beam power of the gyrotron and adjusting the filament voltage to bring a beam current within a range; and adjusting the filament standby voltage as a function of the beam current of the pulse to maintain a proper setting of the standby voltage for a desired beam power.

11. The process of claim 10, comprising using one or more of the following: a power level setting, a pulse duration, a time since last pulse, a filament on time, and a time since last continuous wave (CW) pulse.

12. A process for gyrotron power regulation comprising:

using a processor for raising a filament voltage of a gyrotron to a standby voltage;

using the processor for setting the filament voltage to the standby voltage plus a current offset voltage before pulsing the gyrotron;

using the processor for increasing the filament voltage to a boost voltage that is higher than the standby voltage, thereby inducing a temperature increase in the cathode that offsets the cooling effect of radiating;

using the processor for analyzing a beam power of the gyrotron and adjusting the filament voltage to bring a beam current within a range;

transmitting repeated pulses to the filament and predicting a future beam current and regulating the filament offset voltage as a function of the future beam current.

13. The process of claim 12, comprising:

calculating a new offset voltage by using a distance of the predicted future beam current from an ideal power band.

14. The process of claim 13, comprising making no changes in the offset voltage when the predicted future beam current falls within the ideal power band.

15. The process of claim 13, comprising increasing the offset voltage when the predicted future beam current falls below the ideal power band or decreasing the offset voltage when the predicted future beam current falls above the ideal power band, thereby bringing the beam current back into the ideal power band.

16. The process of claim 13, comprising using one or more of the following configurable parameters: a filament offset minimum, a filament offset maximum, a filament maximum increase, a filament maximum decrement, and a filament low High Voltage Power Supply decrement.

17. A process for gyrotron power regulation comprising:

using a processor for raising a filament voltage of a gyrotron to a standby voltage;

using the processor for setting the filament voltage to the standby voltage plus a current offset voltage before pulsing the gyrotron;

using the processor for increasing the filament voltage to a boost voltage that is higher than the standby voltage, thereby inducing a temperature increase in the cathode that offsets the cooling effect of radiating;

using the processor for analyzing a beam power of the gyrotron and adjusting the filament voltage to bring a beam current within a range; and maximizing a speed at which a filament power supply for a gyrotron is ramped up or ramped down in voltage without overshoot.

18. The process of claim 17, comprising:

commanding a higher voltage or a lower voltage than actually desired; and when the measured voltage passes the desired voltage, commanding the correct voltage and stopping the ramp up or ramp down of the power supply at the correct voltage.

* * * * *

UNITED STATES PATENT AND TRADEMARK OFFICE

CERTIFICATE OF CORRECTION

PATENT NO. : 8,450,951 B2
APPLICATION NO. : 12/327037
DATED : May 28, 2013
INVENTOR(S) : Booker et al.

It is certified that error appears in the above-identified patent and that said Letters Patent is hereby corrected as shown below:

In the Drawings

Figure 9A:
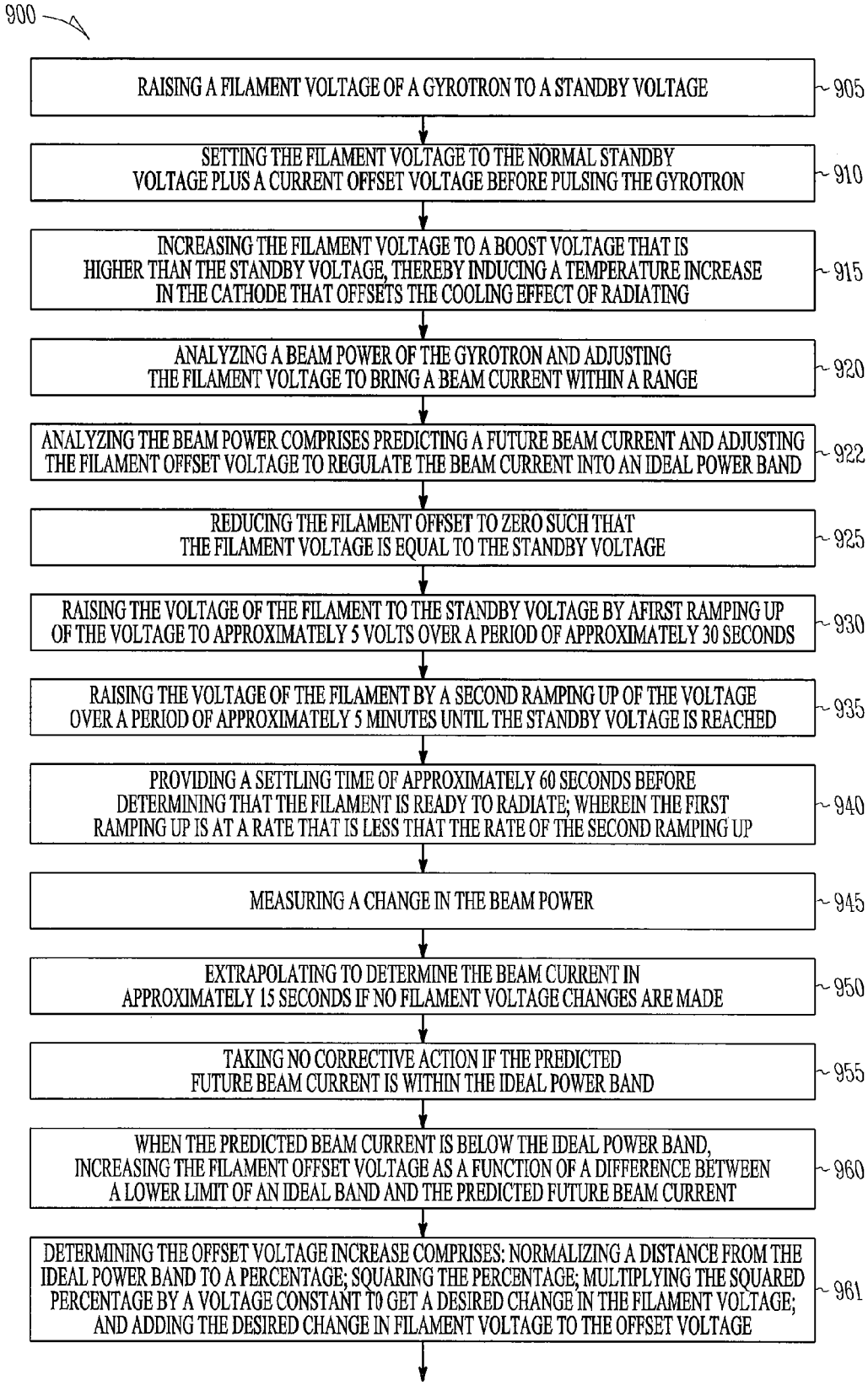
FIGS. 9A and 9B are flowcharts illustrating an example process to regulate the power output of a gyrotron.
Figure 9B:
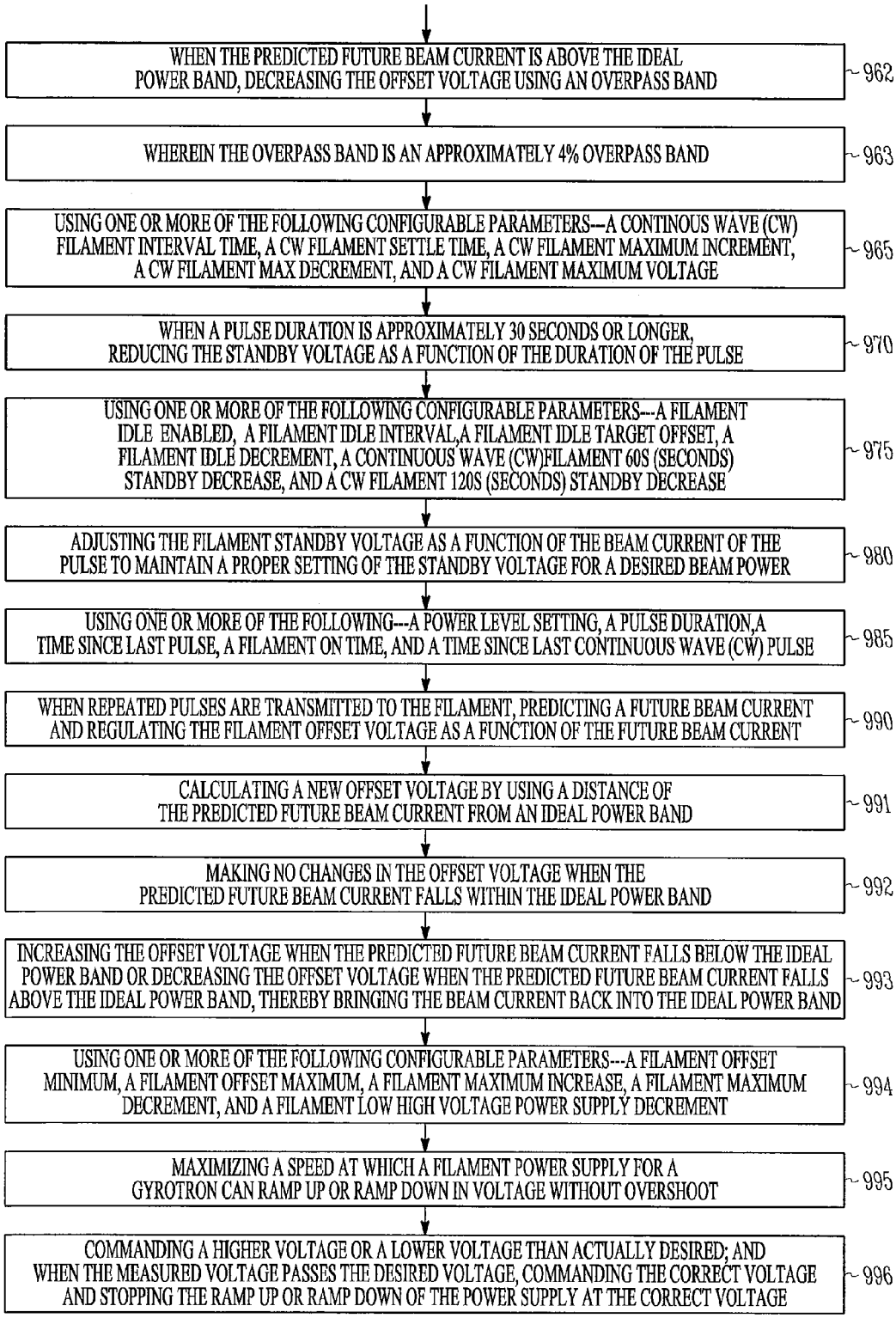

On sheet 2 of 7, Fig. 2, reference numeral 250, line 1, delete "PREDICITVE" and insert --PREDICTIVE--, therefor On sheet 6 of 7, Fig. 9A, reference numeral 930, line 1, delete "AFIRST" and insert --A FIRST--, therefor On sheet 6 of 7, Fig. 9A, reference numeral 940, line 3, delete "THAT" and insert --THAN--, therefor On sheet 7 of 7, Fig. 9B, reference numeral 965, line 1, delete "CONTINOUS" and insert --CONTINUOUS--, therefor On sheet 7 of 7, Fig. 9B, reference numeral 975, line 3, delete "(CW)FILAMENT" and insert --(CW) FILAMENT--, therefor On sheet 7 of 7, Fig. 9B, reference numeral 985, line 1, delete "DURATION,A" and insert --DURATION, A--, therefor In the Specification In column 4, line 44, before "Filament", delete "CW", therefor In column 7, line 3, delete "that" and insert --than--, therefor Signed and Sealed this
Seventeenth Day of December, 2013

Margaret A. Focarino

Margaret A. Focarino
*Commissioner for Patents of the United States Patent and Trademark Office*

In the Claims

In column 8, line 55, in Claim 1, delete “that” and insert --than--, therefor

In column 9, line 52, in Claim 8, after “range”, insert --;--, therefor

In column 10, line 28, in Claim 12, after “filament”, insert --;--, therefor